US009467766B2

(12) United States Patent
Gao et al.

(10) Patent No.: US 9,467,766 B2
(45) Date of Patent: Oct. 11, 2016

(54) CONNECTION MEMBER FOR CONNECTING HEADSET PLUG, HEADSET JACK AND ELECTRONIC DEVICE

(71) Applicant: Xiaomi Inc., Beijing (CN)

(72) Inventors: Yuan Gao, Beijing (CN); Duo Xu, Beijing (CN); Gaocai Han, Beijing (CN)

(73) Assignee: XIAOMI INC., Haidian District, Beijing (CN)

( * ) Notice: Subject to any disclaimer, the term of this patent is extended or adjusted under 35 U.S.C. 154(b) by 0 days.

(21) Appl. No.: 14/327,572

(22) Filed: Jul. 10, 2014

(65) Prior Publication Data

US 2015/0086061 A1 Mar. 26, 2015

Related U.S. Application Data

(63) Continuation of application No. PCT/CN2014/076972, filed on May 7, 2014.

(30) Foreign Application Priority Data

Sep. 24, 2013 (CN) ..... 2013 1 0439607

(51) Int. Cl.
*H04R 25/00* (2006.01)
*H04R 1/10* (2006.01)

(52) U.S. Cl.
CPC ..... *H04R 1/1041* (2013.01); *H04R 2420/05* (2013.01); *H04R 2420/09* (2013.01); *Y10T 29/49005* (2015.01)

(58) Field of Classification Search
CPC ..... H04R 1/1041; H04R 5/033
USPC ..... 381/384, 385, 74
See application file for complete search history.

(56) References Cited

U.S. PATENT DOCUMENTS 8,215,989 B2 * 7/2012 Tamm ..... H01R 13/6594 381/1
2001/0004397 A1 6/2001 Michitsuta et al.
2003/0008564 A1 * 1/2003 Lebron ..... 439/638

(Continued)

FOREIGN PATENT DOCUMENTS

CN 201188488 Y 1/2009
CN 201845914 U 5/2011

(Continued)

OTHER PUBLICATIONS

"International Search Report for PCT/CN2014/076972".

(Continued)

*Primary Examiner* — Brian Ensey
*Assistant Examiner* — Julie X Dang
(74) *Attorney, Agent, or Firm* — Jun He Law Offices P.C.; James J. Zhu

(57) ABSTRACT

The present disclosure relates to a connection member for connecting a headset plug with an electronic device, a headset jack of the electronic device and the electronic device. The connection member comprises a pin, wherein the pin communicates with a terminal positioned near an end portion of the headset plug when the connection member is connected with the headset plug. The connection member disclosed in the present disclosure can reduce the length of the headset to be inserted into the headset jack, and reduce the depth of the headset jack, thereby saving space in the electronic device configured with the headset jack.

20 Claims, 8 Drawing Sheets

(56) References Cited

U.S. PATENT DOCUMENTS

| | | | | |
|---|---|---|---|---|
| 2005/0064764 | A1 | 3/2005 | Shinohara | |
| 2007/0049103 | A1* | 3/2007 | Kashi | H01R 24/58 439/396 |
| 2010/0208631 | A1* | 8/2010 | Zhang | H04L 5/14 370/297 |
| 2010/0239116 | A1* | 9/2010 | Xu | H01R 1/1033 381/384 |

FOREIGN PATENT DOCUMENTS

| | | | |
|---|---|---|---|
| CN | 201986114 | U | 9/2011 |
| CN | 202004937 | U | 10/2011 |
| CN | 202050524 | U | 11/2011 |
| CN | 102281482 | A | 12/2011 |
| CN | 102438059 | A | 5/2012 |
| CN | 102457793 | A | 5/2012 |
| CN | 202353786 | U | 7/2012 |
| CN | 202406261 | U | 8/2012 |
| CN | 202713568 | U | 1/2013 |
| CN | 103108266 | A | 5/2013 |
| CN | 203103619 | U | 7/2013 |
| CN | 103475972 | A | 12/2013 |
| JP | 51-008101 | U1 | 1/1976 |
| JP | 55-039746 | U1 | 3/1980 |
| JP | S6330035 | U | 2/1998 |
| JP | 2000152362 | A | 5/2000 |
| JP | 2003-282199 | A | 10/2003 |
| JP | 2007-110545 | A | 4/2007 |
| KR | 1006199500000 | B1 | 9/2006 |
| RU | 2433565 | C1 | 11/2011 |

OTHER PUBLICATIONS

Extended European Search Report for 14180518.4.

* cited by examiner

CONNECTION MEMBER FOR CONNECTING HEADSET PLUG, HEADSET JACK AND ELECTRONIC DEVICE

CROSS REFERENCE TO RELATED APPLICATIONS

This application is a Continuation of International Application No. PCT/CN2014/076972 with an international filing date of May 7, 2014, which is based upon and claims priority to Chinese Patent Application No. 201310439607.5, filed on Sep. 24, 2013, the entire contents of which are incorporated herein by reference.

TECHNICAL FIELD

The present disclosure relates to the field of electronic technology, and more particularly, to a connection member for connecting a headset plug with an electric device, a headset jack of the electronic device and the electronic device.

BACKGROUND

With the continuous development of electronic device technology, the electronic devices, such as smart phones and pads, have become increasingly popular. More and more people use the electronic devices to work, study, entertain and communicate. The electronic devices are mostly equipped with a headset jack that allows the users to connect the electronic device to a headset. The current headset plugs are standard plugs, for example, the headset plugs with a diameter of 2.5 mm or 3.5 mm. Accordingly, for each standard, there are three-stage and four-stage headset plugs.

In order to improve people's experience, the present electronic devices are becoming thinner, and the screens are becoming larger. This design brings a good experience to people. However, since the electronic devices are becoming thinner and the screens are becoming larger, it is difficult to coordinate the layout of the headset jack and the screen, which causes a contradiction.

SUMMARY

Accordingly, the present disclosure provides a connection member for connecting a headset plug with an electronic device, a headset jack of the electronic device and the electronic device, which can reduce the length of the headset to be inserted into the headset jack.

According to a first aspect of embodiments of the present disclosure, there is provided a connection member for connecting a headset plug with an electric device, comprising a pin, wherein the pin communicates with a terminal positioned near an end portion of the headset plug when the connection member is connected with the headset plug.

The connection member disclosed in the present disclosure can reduce the length of the headset to be inserted into the headset jack, and reduce the depth of the headset jack, thereby saving space in the electronic device configured with the headset jack.

According to a second aspect of embodiments of the present disclosure, there is also provided a headset jack of an electronic device, comprising a contact point, wherein the contact point communicates with a pin of a connection member when the connection member is inserted into the headset jack, and the pin of the connection member communicates with a terminal positioned near an end portion of a headset plug if the connection member is connected with the headset plug.

The headset jack disclosed in the present disclosure may be communicated with the pins of the connection member, thus can reduce the length of the headset to be inserted into the headset jack, and reduce the depth of the headset jack, thereby saving space in the electronic device configured with the headset jack.

According to a third aspect of embodiments of the present disclosure, there is also provided an electronic device, comprising a headset jack having a contact point, wherein the contact point communicates with a pin of a connection member when the connection member is inserted into the headset jack, and the pin of the connection member communicates with a terminal positioned near an end portion of a headset plug if the connection member is connected with the headset plug.

The electronic device disclosed in the present disclosure comprises a shallow headset jack, thereby can save space for other components in the electronic device.

According to a fourth aspect of embodiments of the present disclosure, there is also provided a method of connecting a headset plug with an electronic device by a connection member comprising a pin, the method comprising: inserting the connection member into a headset jack of the electronic device; and connecting the connection member with the headset plug, wherein the pin communicates with a terminal positioned near an end portion of the headset plug when the connection member is connected with the headset plug.

In the present disclosure, a headset may also be a headphone, an earphone or the like, either with or without a microphone.

Other features and advantages of the present disclosure will be explained in the following specification, which may become apparent in part from the specification, or may be learned by implementing the present disclosure. The purposes and other advantages of the present disclosure may be achieved and obtained by the structure specified in the specification, claims and drawings.

It is to be understood that both the foregoing general description and the following detailed description are exemplary and explanatory only and are not restrictive of the disclosure, as claimed. Hereinafter, the technical solutions of the present disclosure are further described in detail through the drawings and embodiments.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure. In the drawings.

Specific embodiments in this disclosure have been shown by way of example in the foregoing drawings and are hereinafter described in detail. The drawings and written description are not intended to limit the scope of the inventive concepts in any manner. Rather, they are provided to illustrate the inventive concepts to a person skilled in the art by referring to particular embodiments.

DETAILED DESCRIPTION

The exemplary embodiments of the present disclosure will be described in combination with the drawings, and it should be appreciated that the exemplary embodiments described herein are only used for describing and explaining the present disclosure, but are not for limiting the present disclosure.

Figure 1:
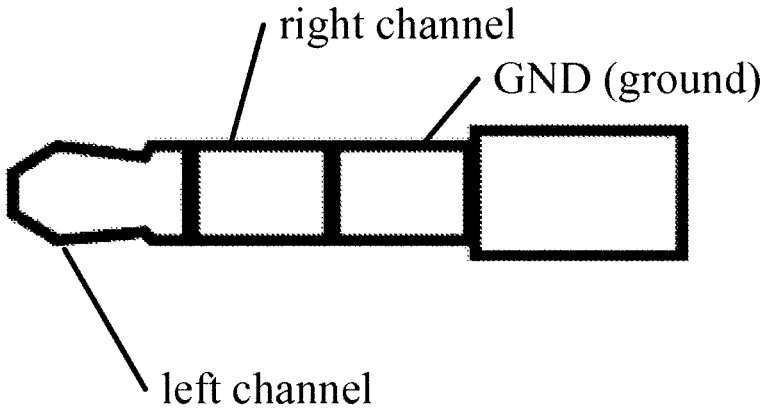
FIG. 1 is a schematic diagram illustrating a three-stage headset plug, according to an exemplary embodiment of the present disclosure.
Figure 2:
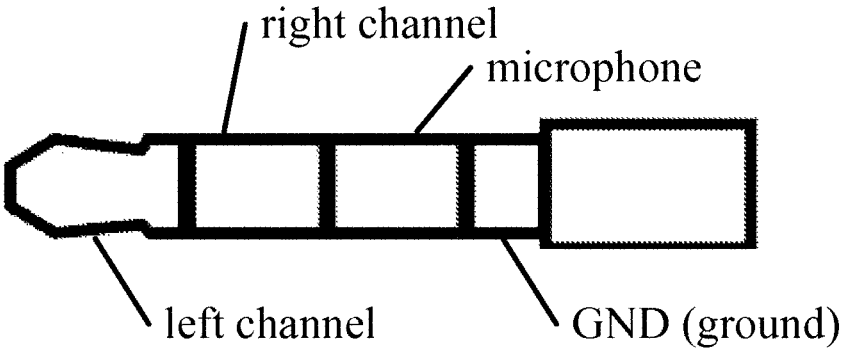
FIG. 2 is a schematic diagram illustrating a four-stage headset plug, according to an exemplary embodiment of the present disclosure.

As shown in FIG. 1, which is a schematic diagram of a three-stage headset plug, the headset plug includes three terminals, which are respectively a left channel, a right channel and GND (ground). As shown in FIG. 2, which is a schematic diagram of a four-stage headset plug, the headset plug has four terminals, which are respectively a left channel, a right channel, a microphone and GND (ground). In general, when the user connects the headset with an electronic device, the user needs to insert the headset plug into a headset jack of the electronic device. The headset jack of electronic device is a headset jack matched with the standard headset plug. Generally, in the electronic device, the layout of the positions of the headset jack and the screen may be as follows.

Figure 3:
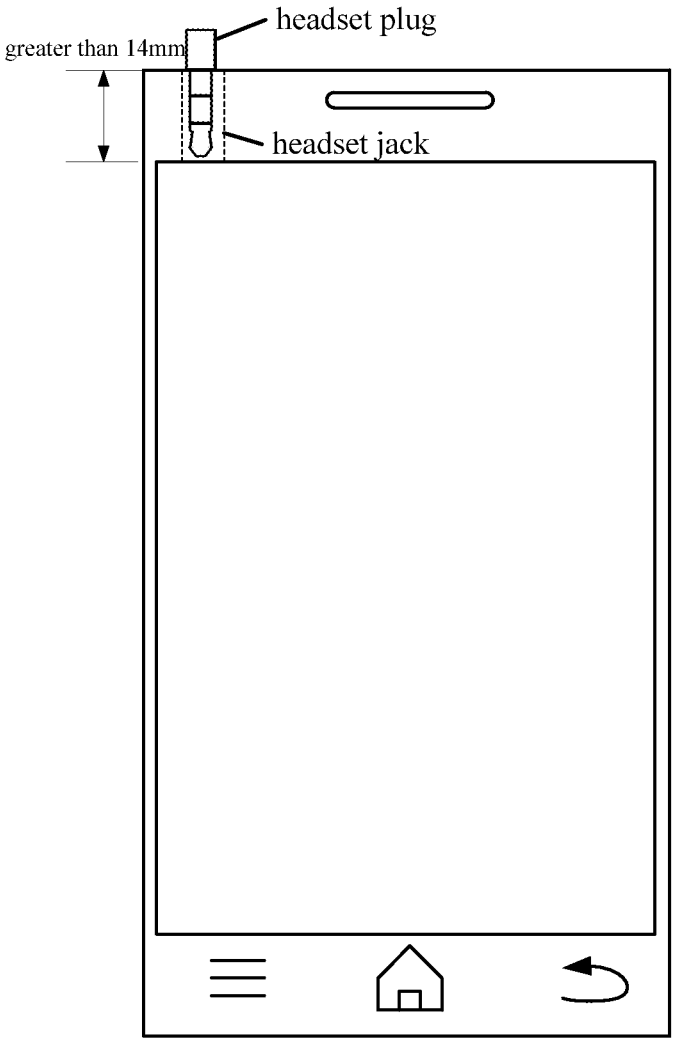
FIG. 3 is a schematic diagram illustrating a state of inserting headset plug into an electronic device according to an exemplary embodiment of the present disclosure, wherein the headset jack is configured at the top of the electronic device.

1. The headset jack is configured at the top or bottom of the electronic device and keeps away from the screen, as shown in FIG. 3, which is a schematic diagram of a state of inserting the headset plug when the headset jack is configured at the top of the electronic device. For example, the headset jack is a headset jack matched with a 3.5 mm headset plug, and the 3.5 mm headset plug has a length of 14 mm. Then, in order to keep the headset jack away from the screen, the area above or below the screen is set to be greater than 14 mm.

Figure 4:
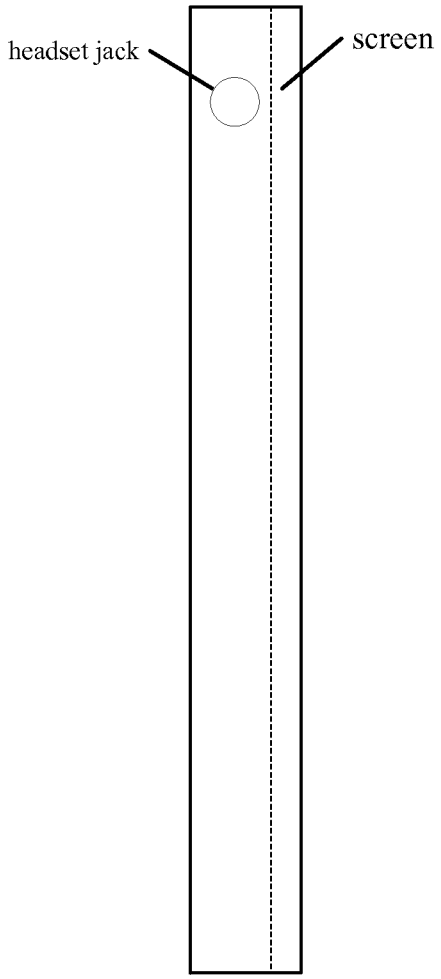
FIG. 4 is a schematic diagram illustrating a state of inserting headset plug into an electronic device according to an exemplary embodiment of the present disclosure, wherein the headset jack is configured at the side of the electronic device.

2. The headset jack is configured at a lateral side of the electronic device (e.g., a mobile phone) and keeps away from the screen, as shown in FIG. 4. Such solution needs to increase the thickness of the electronic device such that the headset jack and the screen could be staggered in the thickness direction.

However, in the above-mentioned first solution, the area above or below the screen is too large, while in the second solution, the thickness of the electronic device will be increased. Therefore, it is difficult to provide increasingly thinner electronic device and increasingly larger screen to users.

Accordingly, the present disclosure provides a connection member for the headset plug, wherein the connection member includes at least one pin. When the connection member is connected with the headset plug, the at least one pin of the connection member is communicated with at least one terminal of the headset plug near an end portion thereof.

In one embodiment, the connection member may be of any shape, and the form of connection with the headset plug may also be of any type, as long as the connection member includes at least one pin which can communicate with at least one terminal of the headset plug positioned near an end portion of the headset plug when the connection member is connected with the headset plug.

Figure 5:
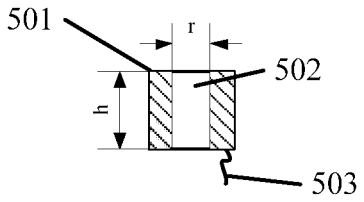
FIG. 5 is a schematic diagram illustrating an embodiment of a connection member, according to an exemplary embodiment of the present disclosure.
Figure 6:
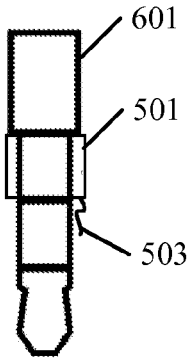
FIG. 6 is a schematic diagram illustrating the connection member connected to the three-stage headset plug, according to an exemplary embodiment of the present disclosure.
Figure 7:
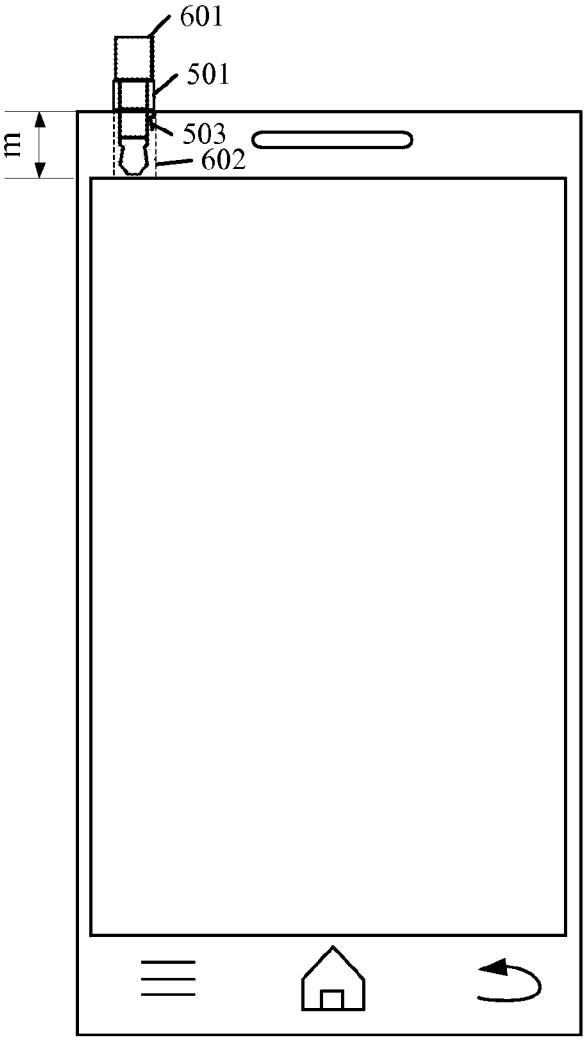
FIG. 7 is a schematic diagram illustrating a state of inserting the headset plug shown in FIG. 6 into an electronic device according to an exemplary embodiment of the present disclosure, wherein the headset jack is configured at the top of the electronic device.

As shown in FIG. 5 which illustrates one embodiment of the connection member, in this embodiment, the connection member is a sleeve 501. The sleeve is hollow, as indicated by the reference sign 502 in FIG. 5. The inner diameter r of the sleeve matches the size of the end portion of the headset plug, i.e., the sleeve can accommodate the end portion of the headset plug. Moreover, the height h of the sleeve is greater than or equal to the sum of widths of the terminals of the headset plug to be communicated. The sleeve has a pin 503, such as a clip. When the connection member is in use, the sleeve 501 is put on a tail portion of the three-stage headset plug, as shown in FIG. 6, and at this time, the pin 503 of the sleeve is communicated with one terminal of the headset plug 601 near the tail portion. As shown in FIG. 7, the headset plug 601 is inserted into the headset jack 602, and the pin 503 is communicated with a corresponding contact point in the headset jack 602 (the contact point in the headset jack is not shown in the drawing). In this embodiment, the headset plug is not fully inserted into the headset jack, and the terminal of the headset plug which is not inserted into the headset jack is communicated with the contact point in the headset jack via the pin of the connection member. As compared with FIG. 3, the portion of the headset plug which is inserted into the headset jack is short, therefore, the required depth m of the headset jack becomes relatively small. As compared with FIG. 3, the depth m is inevitably less than 14 mm, therefore, the screen of the electronic device configured with this kind of headset jack can be set relatively large.

Figure 8:
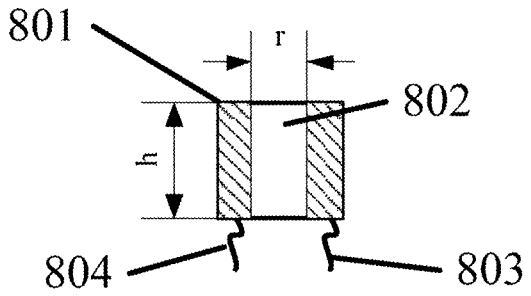
FIG. 8 is a schematic diagram illustrating another embodiment of a connection member, according to an exemplary embodiment of the present disclosure.
Figure 9:
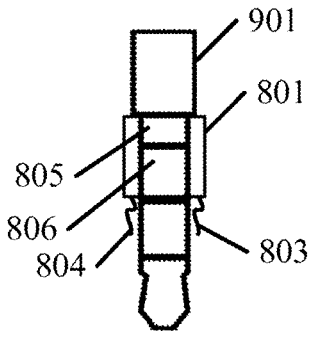
FIG. 9 is a schematic diagram illustrating a state of inserting the connection member shown in FIG. 8 into the four-stage headset plug, according to an exemplary embodiment of the present disclosure.
Figure 10:
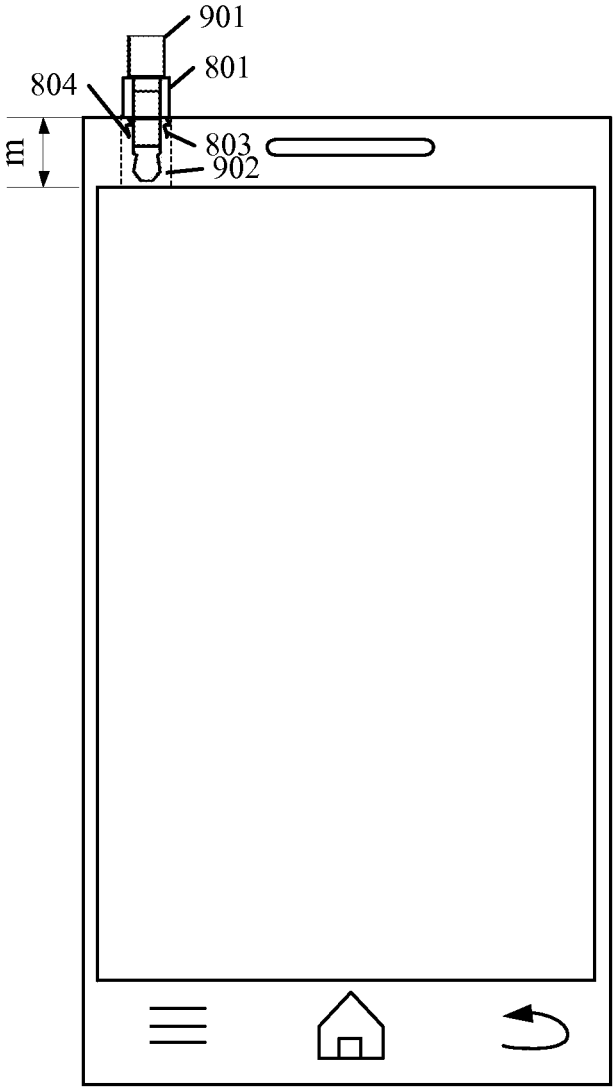
FIG. 10 is a schematic diagram illustrating a state of inserting the headset plug shown in FIG. 9 into an electronic device according to an exemplary embodiment of the present disclosure, wherein the headset jack is configured at the top of the electronic device.

As shown in FIG. 8 which illustrates another embodiment of the connection member, in this embodiment, the connection member is also a sleeve 801. The sleeve is hollow, as indicated by the reference sign 802 in FIG. 8. The inner diameter r of the sleeve can accommodate the end portion of the headset plug; and the height h of the sleeve is greater than or equal to the sum of the widths of terminals of the headset plug to be communicated. The sleeve includes two pins 803 and 804. When the connection member is in use, the sleeve 801 is put on the tail portion of the headset plug 901, and as shown in FIG. 9, the four-stage headset plug 901 is taken as an example. At this time, the pins 803 and 804 of the sleeve are respectively communicated with two terminals 805 and 806 of the headset plug 901 near the tail portion. As shown in FIG. 10, the headset plug 901 is inserted into the headset jack 902, and the pins 803 and 804 of the sleeve 801 are respectively communicated with corresponding contact points in the headset jack 902 (the contact points in the headset jack are not shown in the drawing). In this embodiment, the headset plug is not fully inserted into the headset jack, and the terminals of the headset plug 901 which are not inserted into the headset jack 902 are communicated with the contact points in the headset jack 902 via the pins of the connection member 801. Therefore, as compared with the condition that the headset plug is fully inserted into the headset jack, the required depth m of the headset jack becomes relatively small. Therefore, the screen of the electronic device configured with this headset jack can be set relatively large.

In other embodiments of the present disclosure, when the headset jack is configured on the front of the electronic device or on the back of the electronic device, the connection member proposed in the present disclosure may also be applied when the headset with a standard headset plug is in use.

Figure 11:
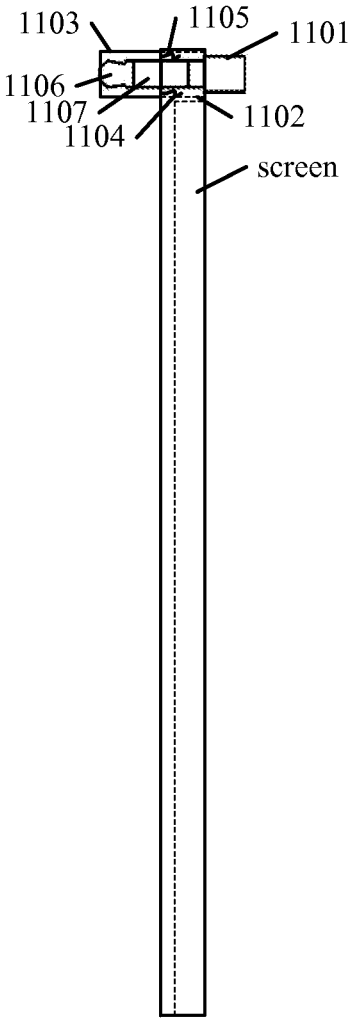
FIG. 11 is a schematic diagram illustrating a state of inserting the headset plug into an electronic device according to an exemplary embodiment of the present disclosure, wherein the headset jack is configured on the front surface of the electronic device.

Furthermore, when using the connection member, it may also be possible to communicate the pin of the connection member with at least one terminal of the headset plug positioned near a head portion of the headset plug. As shown in FIG. 11, the headset plug 1101 is firstly inserted into the headset jack 1102, and then the sleeve 1103 is put on the head portion of the headset plug 1101. At this time, the pins 1104 and 1105 of the sleeve are respectively communicated with the two terminals 1106 and 1107 of the headset plug 1101 near the head portion. Moreover, the pins 1104 and 1105 of the sleeve 1103 are respectively communicated with corresponding contact points in the headset jack 1102 (the contact points in the headset jack are not shown in the drawing). In this embodiment, the headset plug is fully inserted into the headset jack with a shallower depth, and the terminals of the headset plug 1101 protruding out of the headset jack 1102 are communicated with the contact points in the headset jack 1102 via the pins of the connection member 1103. Therefore, the required depth of the headset jack can become relatively small, and thereby, the electronic device configured with this headset jack may be set relatively thin.

In other embodiments of the present disclosure, for example, the connection member can also be a clamp with a pin for clamping the terminal of the headset plug so as to be connected to the headset plug and for communicating the pin with the terminal of the clamped headset plug.

The present disclosure also provides a headset jack cooperating with the aforesaid connection member and having at least one contact point. When the headset plug is inserted into the headset jack, and the headset plug is connected with the connection member, said at least one contact point is communicated with at least one pin of the connection member. The connection member is configured as follows: when the connection member is connected to the headset plug, at least one pin of the connection member is communicated with at least one terminal of the headset plug near an end portion thereof.

The depth of the headset jack is determined by subtracting a sum of widths of the terminals communicated with the pins of the connection member from a sum of widths of all terminals of the headset plug, when the headset plug is connected to the connection member.

Figure 12:
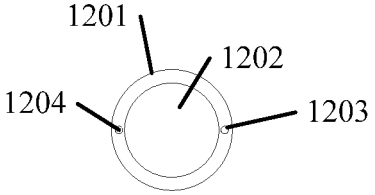
FIG. 12 is a schematic diagram illustrating an embodiment of a headset jack, according to an exemplary embodiment of the present disclosure.

The at least one contact point may be located at an end portion of the headset jack or within a channel of the headset jack. FIG. 12 illustrates a schematic diagram of one embodiment of the headset jack. FIG. 12 is a top view of the headset jack, wherein the reference sign 1201 indicates the headset jack with a hollow center portion 1202 for inserting the headset plug, and the contact points 1203 and 1204 are located at the end portion of the headset jack 1201 for communicating with the pins of the connection member. In other embodiments of the present disclosure, the contact points may be located within the center portion 1202.

Figure 13:
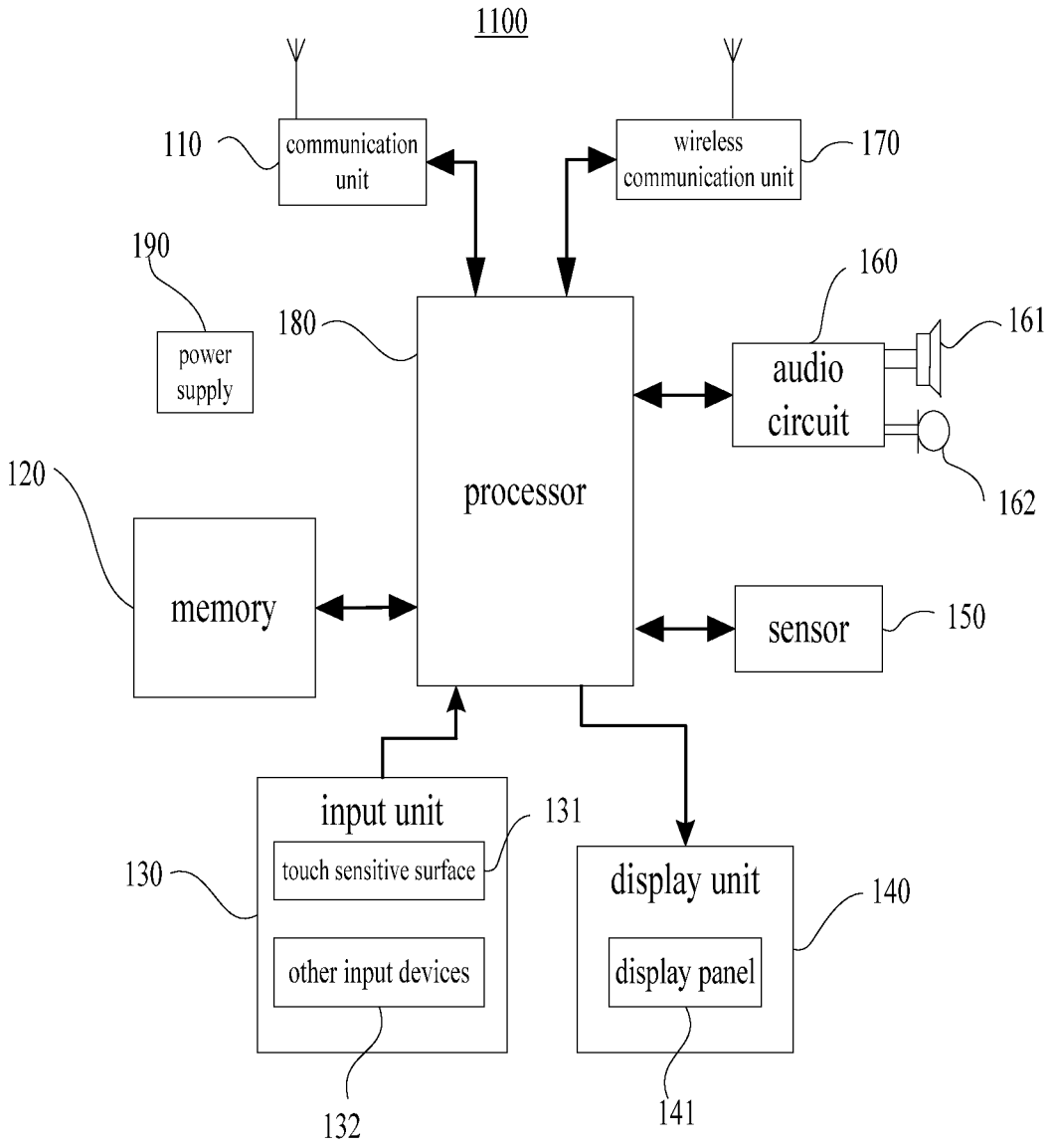
FIG. 13 is a structural diagram of an electronic device, according to an exemplary embodiment of the present disclosure.

The present disclosure also provides an electronic device. FIG. 13 is a structural diagram of an electronic device provided by the present disclosure. Referring to FIG. 13, the electronic device 1100 may include a communication unit 110, a memory 120 including one or more computer-readable storage medium, an input unit 130, a display unit 140, a sensor 150, an audio circuit 160, a WiFi (wireless fidelity) module 170, a processor 180 including one or more processing core members, a power supply 190, and other components. The person skilled in the art should appreciate that the structure of the electronic device shown in FIG. 13 does not constitute the limitation to the electronic device, but may include more or less components than those shown in the drawing, or may combine some of the components, or may have different arrangement of the components.

The communication unit 110 is configured to receive and transmit signals during information receipt and transmission or during a call. The communication unit 110 may be a RF (radio frequency) circuit, a router, a modem, or other network communication device. Specifically, in the case that the communication unit 110 is the RF circuit, after receiving the downlink information from the base station, the one or more processors 780 processes the downlink information; additionally, the uplink data is transmitted to the base station. Generally, the RF circuit serving as the communication unit includes, but is not limited to an antenna, at least one amplifier, a tuner, one or more oscillators, a subscriber identity module (SIM) card, a transceiver, a coupler, a LNA (Low Noise Amplifier), a duplexer, etc. Additionally, the communication unit 110 may also communicated with network and other devices via wireless communication. The wireless communication may adopt any communication standards or protocols, including but not limited to GSM (Global System of Mobile communication), GPRS (General Packet Radio Service), CDMA (Code Division Multiple Access), WCDMA (Wideband Code Division Multiple Access), LTE (Long Term Evolution), E-mail, SMS (Short Messaging Service), etc. The memory 120 may be configured to store software programs and modules, and the processor 180 performs various functional applications and data processing by executing the software programs and modules stored in the memory 120. The memory 120 may mainly include a program storage part and a data storage part, wherein the program storage part may store instructions for an operation system, an application program required by at least one function (such as an audio playing function, an image playback function) and the like; and the data storage part may store the data created according to the usage of the electronic device 1100 (such as audio data, a phone book) and the like. In addition, the memory 120 may include a high random access memory, and may also include a non-transitory memory, such as at least one disc storage device, flash device or other transitory solid-state storage device. Accordingly, the memory 120 may also include a memory controller for providing the processor 180 and the input unit 130 with an access to the memory 120.

The input unit 130 may be configured to receive the input digits or character information, and generate signal inputs of a keyboard, a mouse, a joystick or a trackball related to the user settings and function control. For example, the input unit 130 may include a touch sensitive surface 131 and other input devices 132. The touch sensitive surface 131, which is also be referred to as a touch screen or a touch pad, can collect the user's touch operation thereon or thereabout (for example, the user performs operations on the touch sensitive surface 131 or near the touch sensitive surface 131 by using fingers, a stylus, or any suitable object or accessory), and drive the corresponding connected device according to the preset program. Optionally, the touch sensitive surface 131 may include two parts, i.e., a touch detection device and a touch controller, wherein the touch detection device detects a touch orientation of the user and signals caused by the touch operation, and transmits the signals to the touch controller; and the touch controller receives the touch information from the touch detection device, converts the touch information into a contact coordinate and transmits it to the processor 180, and the touch controller can also receive the instruction from the processor 180 and execute the instruction. Additionally, the touch sensitive surface 131 may be achieved by adopting various types, such as a resistive type, a capacitive type, an infrared ray type, and a surface acoustic wave type. Besides the touch sensitive surface 131, the input unit 130 may also include other input device 132. The other input devices 132 may include but not limited to one or more of a physical keyboard, a function key (such as a volume control key, a switch key), a trackball, a mouse, a joystick, etc.

The display unit 140 may be configured to display information input by the user or information provided to the user and various kinds of graphical user interfaces of the electronic device 1100, and the graphical user interfaces may be constituted by a graphic, a text, an icon, a video and any combination thereof. The display unit 140 may include a display panel 141. Optionally, the display panel 141 may be configured in the form of a LCD (Liquid Crystal Display), an OLED (Organic Light-Emitting Diode) and the like. Further, the touch sensitive surface 131 may cover with the display panel 141. When the touch operation on or near the touch sensitive surface 131 is detected, the touch sensitive surface 131 transmits the touch operation to the processor 180 to determine the type of the touch event, and then the processor 180 provides a corresponding visual output on the display panel 141 according to the type of the touch event. Although in FIG. 13, the touch sensitive surface 131 and the display panel 141 act as two independent components to achieve input and input functions, in some embodiments, the touch sensitive surface 131 and the display panel 141 may be integrated to achieve the input and output functions.

The electronic device 1100 may further include at least one sensor 150, such as a light sensor, a motion sensor, and other sensors. The light sensor may include an ambient light sensor and a proximity sensor, wherein the ambient light sensor may adjust the brightness of the display panel 141 according to the light and shade of the ambient light, and the proximity sensor may turn off the display panel 141 and/or the backlight when the electronic device 1100 is moved to the ear. As one type of the motion sensors, the gravity acceleration sensor may detect the magnitude of the acceleration along respective directions (in general, three axes), may detect the magnitude and direction of the gravity when being stationary, and may identify the applications of the attitudes of the mobile phone (such as a horizontal and vertical screen switching, a relevant game, a magnetometer attitude calibration) and functions relevant to vibration identification (such as a pedometer, a percussion) and the like. The electronic device 1100 may also be configured with a gyroscope, a barometer, a hygrometer, a thermometer, an infrared sensor and other sensors, which are not repeated herein.

The audio circuit 160, a speaker 161 and a microphone 162 may provide the audio interfaces between the user and the electronic device 1100. The audio circuit 160 may transmit an electrical signal converted from the received audio data to the speaker 161, and the speaker 161 converts the electrical signal into an acoustical signal and outputs it. On the other hand, the microphone 162 converts the collected acoustical signal into an electrical signal, the audio circuit 160 receives the electrical signal, converts it into an audio signal, and output the audio signal to the processor 180 for being processed, then the processed audio signal is for example transmitted to another electronic device via the RF circuit 110, or the audio signal is output to the memory 120 for further processing. The audio circuit 160 may also include a headset jack for providing the communication between the peripheral headset and the electronic device 1100. The headset jack of the present disclosure has at least one contact point. When the headset plug is inserted into the headset jack, and the headset plug is connected with the connection member, said at least one contact point is connected to at least one pin of the connection member. The connection member is configured as follows: when the connection member is connected to the headset plug, at least one pin of the connection member is communicated with at least one terminal of the headset plug near the end portion thereof.

The depth of the headset jack is determined by subtracting a sum of widths of the terminals communicated with the pins of the connection member from a sum of widths of all terminals of the headset plug, when the headset plug is connected to the connection member.

The at least one contact point may be located at the end portion of the headset jack of the electronic device or within the channel of the headset jack of the electronic device.

In order to achieve the wireless communication, the wireless communication unit 170 may be configured on the electronic device. The wireless communication unit 170 may be a WiFi module. The WiFi belongs to the short-range wireless transmission technology. The electronic device 1100 may assist the user to send and receive E-mails, browse the web, access the streaming media and the like via the wireless communication unit 170, and provide the user with the wireless broadband Internet access. Although the wireless communication unit 170 is shown in the drawing, it may be appreciated that the wireless communication unit 170 is not a necessary constitution of the electronic device 1100, and can be omitted according to requirements without changing the essential scope of the present disclosure.

The processor 180 is a control center of the electronic device 1100. The processor 180 connects respective parts of the entire mobile phone via various interfaces and wirings, and performs various functions of the electronic device 1100 and processes data so as to wholly monitor the mobile phone, by running or executing the software programs and/or modules within the memory 120 and calling the data stored in the memory 120. Optionally, the processor 180 may include one or more processing core members. For example, the processor 180 may integrate with the application processor and the modem processor, wherein the application processor mainly processes the operation system, the user interface, the application program, etc., and the modem processor mainly processes the wireless communication. It may be appreciated that the modem processor may not be integrated into the processor 180.

The electronic device 1100 further includes a power supply 190 (such as a battery) for supplying power to respective components. For example, the power supply may be connected to the processor 180 logically via a power management system, so as to achieve the functions of a charge management, a discharge management and a power consumption management by the power management system. The power supply 190 may also include any components, such as one or more direct current or alternative current power supplies, recharging systems, power failure detection circuits, power converters or inverters, and power status indicators.

Although not shown in the drawing, the electronic device 1100 may also include a camera, a Bluetooth module, and the like, which are not repeated herein. In the present embodiment, the display unit of the electronic device is a touch screen display, and the electronic device further includes a memory and one or more programs which are stored in the memory and are configured to be executed by the one or more processors.

In addition, typically, the mobile electronic device described in the present disclosure may be various handheld electronic devices, such as a mobile phone, and a personal digital assistant (PDA). Thereby, the protection scope of the present disclosure should not be restricted to any specific type of mobile electronic device.

Additionally, the method according to the present disclosure may be implemented as the computer program executed by CPU. When the computer program is executed by the CPU, the above functions defined in the method of the present disclosure are performed.

Furthermore, the above steps in the method and the units in the system may also be realized by using the controller and the computer-readable storage medium which stores the computer program for causing the controller to achieve the above steps or unit functions.

Moreover, it should be understood that the computer-readable storage medium (such as the memory) described in the present disclosure may be a transitory or non-transitory memory, or a combination thereof. As an example and not restrictive, the non-transitory memory may include a read-only memory (ROM), a programmable ROM (PROM), an erasable programmable ROM (EPROM), an electrically erasable programmable ROM (EEPROM), or a flash memory. The transitory memory may include a random access memory (RAM) which can act as an external cache memory. As an example and not restrictive, RAM may be obtained in various forms, such as a synchronous RAM (DRAM), a dynamic RAM (DRAM), a synchronous DRAM (SDRAM), a double data rate SDRAM (DDR SDRAM), an enhanced SDRAM (ESDRAM), a synchronization link DRAM (SLDRAM), and a direct RambusRAM (DRRAM). The storage devices in the aspects of the present disclosure are intended to include, but not limited to, these and any other suitable types of memory.

The person skilled in the art should also understand that the various illustrative logical blocks, modules, circuits and algorithm steps described in combination with the contents disclosed herein may be implemented as an electronic hardware, computer software or a combination thereof. In order to clearly explain the interchangeability between the hardware and the software, a general description has been given in terms of the functions of various illustrative components, blocks, modules, circuits and steps. These functions are implemented as the software or implemented as the hardware depending on the particular applications and the design constraints imposed to the whole system. The person skilled in the art may realize these functions in various manners with respect to each kind of particular application, but this realization should not be interpreted as departing from the scope of the present disclosure.

The various illustrative logical blocks, modules and circuits described in combination with the contents disclosed herein may be realized or executed by the following components which are designed for executing the above functions: a general purpose processor, a digital signal processor (DSP), an application specific IC (ASIC), a field programmable gate array (FPGA), or other programmable logic devices, a discrete gate, or a transistor logic, a discrete hardware element or any combination thereof. The general purpose processor may be a microprocessor. Alternatively, the processor may be any conventional processor, controller, microcontroller or state machine. The processor may also be implemented as a combination of the computing devices, such as a combination of a DSP and a microprocessor, a plurality of microprocessors, one or more microprocessor combined with a DSP core, or any other such configurations.

The steps of the method or algorithm described in combination with the contents disclosed herein may be directly included in the hardware, in the software module executed by the processor, or in a combination thereof. The software module may reside in a RAM, a flash memory, a ROM, an EPROM, an EEPROM, a register, a hard disk, a removable disk, a CD-ROM, or any other storage mediums of any forms known in the art. The exemplary storage medium is coupled to the processor such that the processor can read information from the storage medium or write information into the storage medium. In an alternative solution, the storage medium may be integrated to the processor. The processor and the storage medium may reside in an ASIC. The ASIC may reside in a user terminal. In an alternative solution, the processor and the storage medium may reside in the user terminal as discrete components.

In one or more exemplary designs, the functions may be implemented in hardware, software, firmware, or any combination thereof. If the functions are implemented in software, the functions may be stored in the computer-readable storage medium or may be transmitted by the computer-readable medium as one or more instructions or codes. The computer-readable medium includes a computer storage medium and a communication medium, and the communication medium includes any medium assisting the transmission of the computer program from one place to another place. The storage medium may be any available medium which is able to be accessed by a general purpose or special purpose computer. As an example and not restrictive, the computer-readable medium may include a RAM, a ROM, an EEPROM, a CD-ROM or other optical disc storage devices, magnetic disc storage devices or other magnetic storage devices, or may be any other media which are used to carry or store the desired program codes in the form of instructions or data structures and can be accessed by a general purpose or special purpose computer or a general purpose or special purpose processor. Also, any linking may be properly referred to as the computer-readable medium. For example, if sending the software from a website, a server, or other remote sources by a coaxial cable, a fiber optic cable, a twisted pair, a digital subscriber line (DSL), or a wireless technology such as an infrared, a radio and a microwave technologies, the above coaxial cable, fiber optic cable, twisted pair, DSL, or wireless technology such as the infrared, the radio and the microwave technologies are included in the definition of the media. As used herein, the magnetic disc and the optical disc include a compact disc (CD), a laser disc, an optical disc, a digital versatile disc (DVD), a floppy disc and a blue-ray disc, wherein the magnetic disc usually reproduces data magnetically, while the optical disc reproduces data optically with lasers. The combinations of the above contents should also be included within the scope of the computer-readable medium.

Although the exemplary embodiments of the present disclosure are illustrated in the above contents, it should be noted that various changes and modifications may be made to the disclosed exemplary embodiments without departing from the scope of the present disclosure as defined in the claims. The functions, steps and/or actions in the method claims according to the disclosed embodiments described herein need not be performed in any specific order. In addition, although the elements of the present disclosure may be described or claimed in the individual form, they can also be conceived to be more, unless they are explicitly restricted to be singular.

The above-mentioned specific embodiments further explain the purposes, technical solutions and advantageous effects of the present disclosure in detail, and it should be understood that the above contents are only specific implementations of the present disclosure, but are not intended to limit the protection scope of the present disclosure. Any modifications, equivalent replacements, improvements and the like made within the spirit and principles of the present disclosure should be included in the protection scope of the present disclosure.

What is claimed is:

1. A connection member for connecting a headset plug with a headset jack of an electric device, comprising:

a hollow sleeve for accommodating a terminal of the headset plug positioned near an end portion of the headset plug; and a pin attached to the hollow sleeve and electronically communicated with the terminal of the headset plug, wherein when the headset plug is inserted into the headset jack, the terminal of the headset plug is prevented from inserting into the headset jack by the hollow sleeve and the pin contacts with a contact point in the headset jack.

2. The connection member according to claim 1, wherein the inner diameter of the sleeve matches the size of the end portion of the headset plug.

3. The connection member according to claim 2, wherein the height of the sleeve is greater than or equal to the sum of widths of the terminals of the headset plug.

4. The connection member according to claim 1, wherein the pin comprises a clip.

5. The connection member according to claim 1, wherein the headset plug is a four-stage headset plug and the connection member further comprises a second pin, and the second pin electronically communicates with a second terminal positioned near the end portion of the headset plug when the connection member is connected with the headset plug.

6. The connection member according to claim 1, wherein the end portion is a head portion of the headset plug.

7. The connection member according to claim 1, wherein the end portion is a tail portion of the headset plug.

8. A headset jack of an electronic device, comprising a contact point, wherein when a headset plug is inserted into the headset jack via a connection member, the contact point contacts with a pin of the connection member and the pin electronically connects the contact point with a terminal of the headset plug positioned near an end portion of the headset plug; and wherein the depth of the headset jack is configured to reduce by a width of the terminal of the headset plug because the terminal of the headset plug is prevented from inserting into the headset jack.

9. The headset jack according to claim 8, wherein the depth of the headset jack is determined by subtracting a sum of widths of the terminals communicated with the pins of the connection member from a sum of widths of all terminals of the headset plug, when the headset plug is connected to the connection member.

10. The headset jack according to claim 8, wherein the contact point is located at an end portion of the headset jack.

11. The headset jack according to claim 8, wherein the contact point is located within a channel of the headset jack.

12. An electronic device, comprising a headset jack having a contact point, wherein when a headset plug is inserted into the headset jack via a connection member, the contact point contacts with a pin of the connection member and the pin electronically connects the conctact point with a terminal of the headset plug positioned near an end portion of the headset plug; and wherein the depth of the headset jack is configured to reduce by a width of the terminal of the headset plug because the terminal of the headset plug is prevented from inserting into the headset jack.

13. The electronic device according to claim 12, wherein the depth of the headset jack is determined by subtracting a sum of widths of the terminals communicated with the pins of the connection member from a sum of widths of all terminals of the headset plug, when the headset plug is connected to the connection member.

14. The electronic device according to claim 12, wherein the contact point is located at an end portion of the headset jack.

15. The electronic device according to claim 12, wherein the at least one contact point is within a channel of the headset jack.

16. A method of connecting a headset plug with an electronic device by a connection member comprising a hollow sleeve and a pin attached to the hollow sleeve, the method comprising:

inserting the pin of the connection member into a headset jack of the electronic device; and connecting the connection member with the headset plug, wherein the hollow sleeve accommodates a terminal of the headset plug positioned near an end portion of the headset plug and the pin electronically communicates with the terminal of the headset plug, and wherein the terminal of the headset plug is prevented from inserting into the headset jack by the hollow sleeve and the pin contacts with a contact point in the headset jack.

17. The method according to claim 16, wherein the inner diameter of the sleeve matches the size of the end portion of the headset plug.

18. The method according to claim 16, wherein the height of the sleeve is greater than or equal to the sum of widths of the terminals of the headset plug.

19. The method according to claim 16, wherein the pin comprises a clip.

20. The method according to claim 16, wherein the headset plug is a four-stage headset plug and the connection member comprises a second pin, and the second pin electronically communicates with a second terminal positioned near the end portion of the headset plug when the connection member is connected with the headset plug.

* * * * *